US005718364A

United States Patent [19]

McDowell

[11] Patent Number: 5,718,364

[45] Date of Patent: Feb. 17, 1998

[54] HARMONICA SHOULDER HOLSTER

[76] Inventor: Garry L. McDowell, 1405 Shenandoah Dr., Spindale, N.C. 28160

[21] Appl. No.: 684,586

[22] Filed: Jul. 19, 1996

[51] Int. Cl.[6] ..... A45F 3/02

[52] U.S. Cl. ..... 224/603; 224/623; 224/647; 224/661; 224/910; 224/191

[58] Field of Search ..... 224/153, 582, 224/191, 600, 603–606, 623–627, 637, 641, 645, 646, 647, 650, 652, 660, 661, 910

[56] References Cited

U.S. PATENT DOCUMENTS

| | | | |
|---|---|---|---|
| 1,871,223 | 8/1932 | Reese | 224/661 |
| 4,318,502 | 3/1982 | Lowe et al. | 224/153 |
| 4,722,464 | 2/1988 | Wright | 224/624 |
| 4,836,426 | 6/1989 | Munn et al. | 224/625 |
| 4,852,782 | 8/1989 | Wu et al. | 224/661 |
| 5,022,574 | 6/1991 | Cesari | 224/153 |
| 5,263,618 | 11/1993 | Talavera | 224/605 |

FOREIGN PATENT DOCUMENTS

| | | | |
|---|---|---|---|
| 60796 | 9/1982 | European Pat. Off. | 224/153 |
| 2595220 A | 9/1987 | France | 224/191 |
| 2251544 | 7/1992 | United Kingdom | 224/206 |

*Primary Examiner*—Henry J. Recla
*Assistant Examiner*—Gregory M. Vidovich

[57] ABSTRACT

A new Harmonica Shoulder Holster for offering an easy, efficient, and attractive means of carrying musical harmonicas. The inventive device includes a backing material, a plurality of harmonica pockets, a plurality of note pockets, a leg strap, a pants strap, and a shoulder strap. In use, the Harmonica Shoulder Holster 10 is equipped with harmonicas 6, notes, a pen 4, and a pencil 2. The device is then slung over the left shoulder of the musician and the pant straps 16 are then fastened to a musician's pants using the strap clamps 17. Finally, the leg strap 15 is fastened to the musician's left leg using the leg strap attachment means 21.

10 Claims, 3 Drawing Sheets

HARMONICA SHOULDER HOLSTER

BACKGROUND OF THE INVENTION

1. Field of the Invention

The present invention relates to harmonicas used for musical practice and more particularly pertains to a new Harmonica Shoulder Holster for offering an easy, efficient, and attractive means of carrying musical harmonicas.

2. Description of the Prior Art

The use of harmonicas used for musical practice is known in the prior art. More specifically, harmonicas used for musical practice heretofore devised and utilized are known to consist basically of familiar, expected and obvious structural configurations, notwithstanding the myriad of designs encompassed by the crowded prior art which have been developed for the fulfillment of countless objectives and requirements.

Known prior art harmonicas used for musical practice include U.S. Pat. No. 5,199,621; U.S. Pat. No. 4,843,649; U.S. Pat. Des. No. 292,849; U.S. Pat. No. 5,174,482; U.S. Pat. No. 5,400,935; and U.S. Pat. No. 5,246,153.

While these devices fulfill their respective, particular objectives and requirements, the aforementioned patents do not disclose a new Harmonica Shoulder Holster. The inventive device includes a backing material, a plurality of harmonica pockets, a plurality of note pockets, a leg strap, a pants strap, and a shoulder strap.

In these respects, the Harmonica Shoulder Holster according to the present invention substantially departs from the conventional concepts and designs of the prior art, and in so doing provides an apparatus primarily developed for the purpose of offering an easy, efficient, and attractive means of carrying musical harmonicas.

SUMMARY OF THE INVENTION

In view of the foregoing disadvantages inherent in the known types of harmonicas used for musical practice now present in the prior art, the present invention provides a new Harmonica Shoulder Holster construction wherein the same can be utilized for offering an easy, efficient, and attractive means of carrying musical harmonicas.

The general purpose of the present invention, which will be described subsequently in greater detail, is to provide a new Harmonica Shoulder Holster apparatus and method which has many of the advantages of the harmonicas used for musical practice mentioned heretofore and many novel features that result in a new Harmonica Shoulder Holster which is not anticipated, rendered obvious, suggested, or even implied by any of the prior art harmonicas used for musical practice, either alone or in any combination thereof.

To attain this, the present invention generally comprises a backing material, a plurality of harmonica pockets, a plurality of note pockets, a leg strap, a pants strap, and a shoulder strap.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Harmonica Shoulder Holster apparatus and method which has many of the advantages of the harmonicas used for musical practice mentioned heretofore and many novel features that result in a new Harmonica Shoulder Holster which is not anticipated, rendered obvious, suggested, or even implied by any of the prior art harmonicas used for musical practice, either alone or in any combination thereof.

It is another object of the present invention to provide a new Harmonica Shoulder Holster which may be easily and efficiently manufactured and marketed.

It is a further object of the present invention to provide a new Harmonica Shoulder Holster which is of a durable and reliable construction.

An even further object of the present invention is to provide a new Harmonica Shoulder Holster which is susceptible of a low cost of manufacture with regard to both materials and labor, and which accordingly is then susceptible of low prices of sale to the consuming public, thereby making such Harmonica Shoulder Holster economically available to the buying public.

Still yet another object of the present invention is to provide a new Harmonica Shoulder Holster which provides in the apparatuses and methods of the prior art some of the advantages thereof, while simultaneously overcoming some of the disadvantages normally associated therewith.

Still another object of the present invention is to provide a new Harmonica Shoulder Holster for offering an easy, efficient, and attractive means of carrying musical harmonicas.

Yet another object of the present invention is to provide a new Harmonica Shoulder Holster which includes a backing material, a plurality of harmonica pockets, a plurality of note pockets, a leg strap, a pants strap, and a shoulder strap.

Still yet another object of the present invention is to provide a new Harmonica Shoulder Holster that is comfortable to wear.

Even still another object of the present invention is to provide a new Harmonica Shoulder Holster that holds all of the key elements needed for a musical performer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
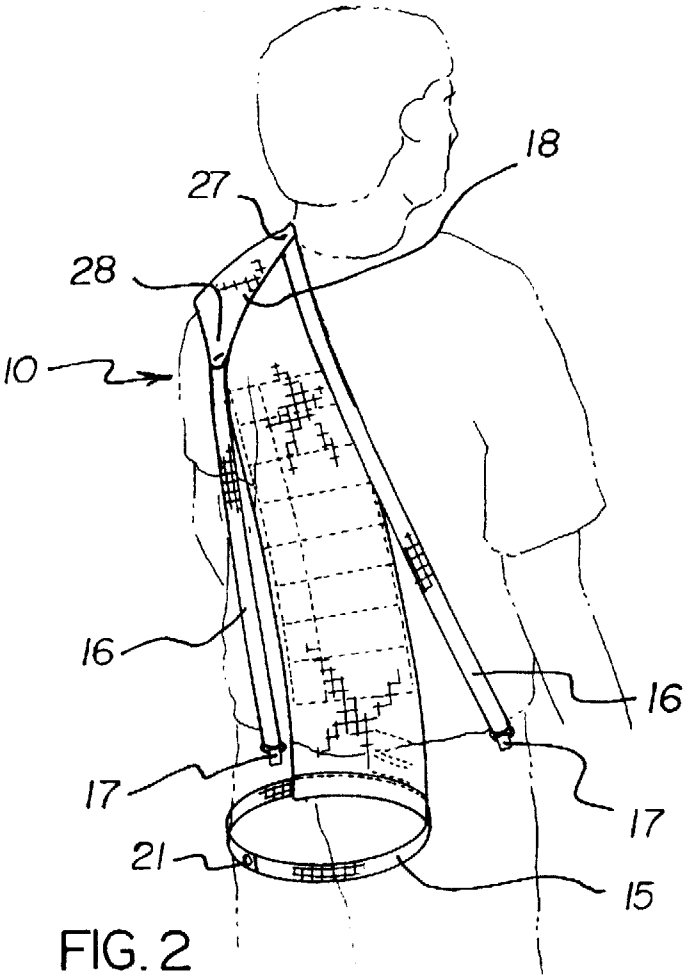
FIG. 2 is a rear perspective view of a new Harmonica Shoulder Holster in use according to the present invention.
Figure 1:
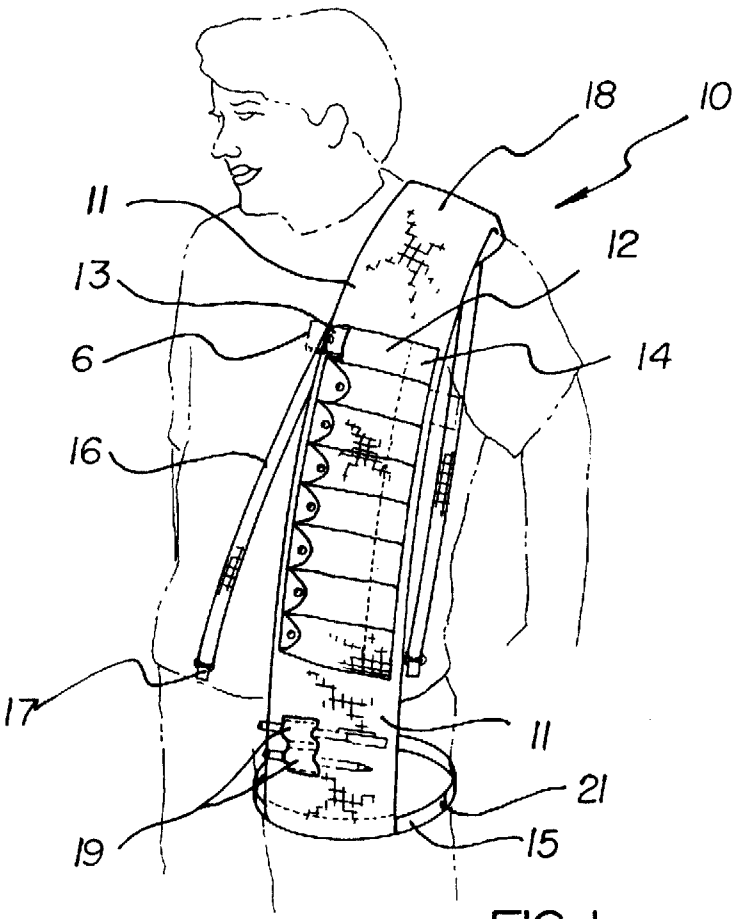
FIG. 1 is a front perspective view of a new Harmonica Shoulder Holster in use according to the present invention.
Figure 3:
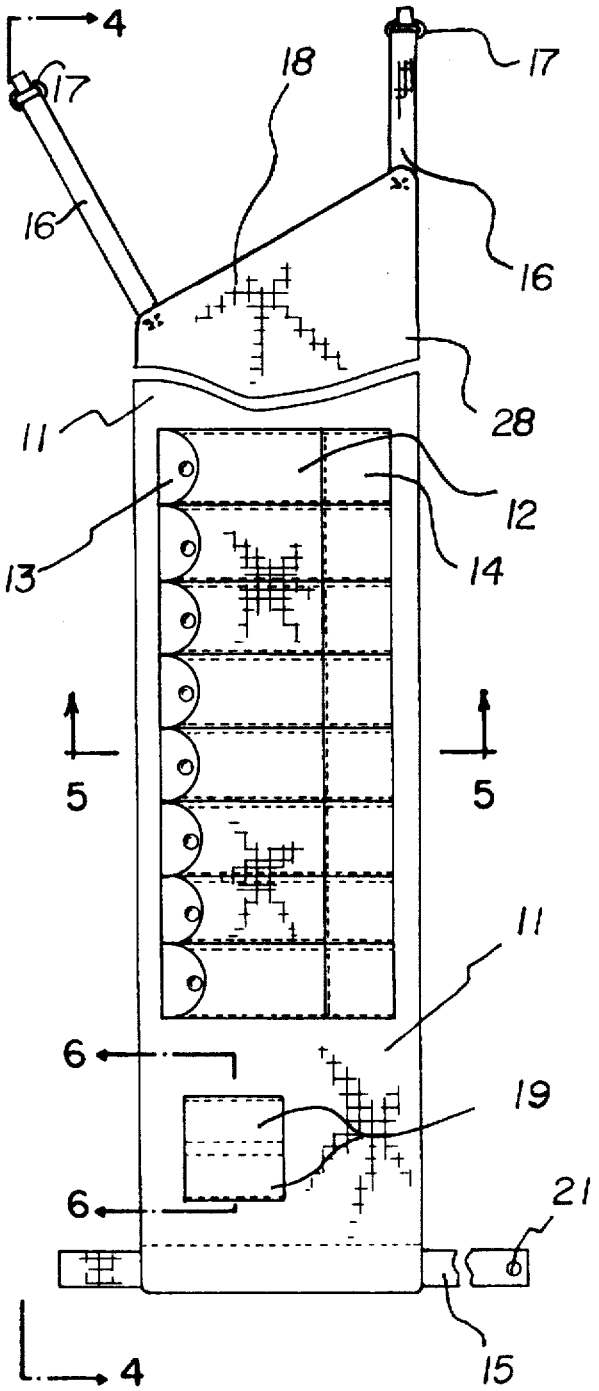
FIG. 3 is a front elevation view thereof.
Figure 4:
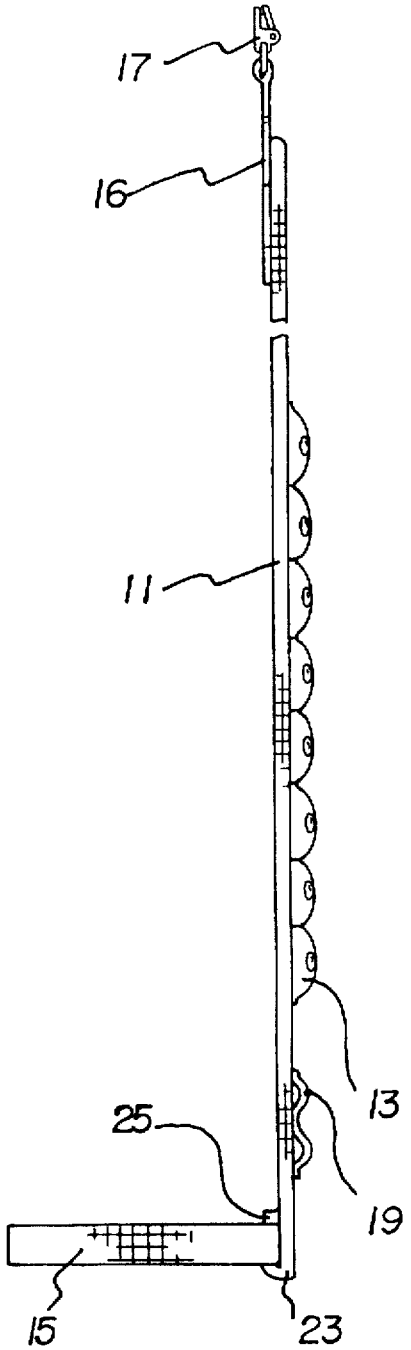
FIG. 4 is a side elevation view thereof.
Figure 5:
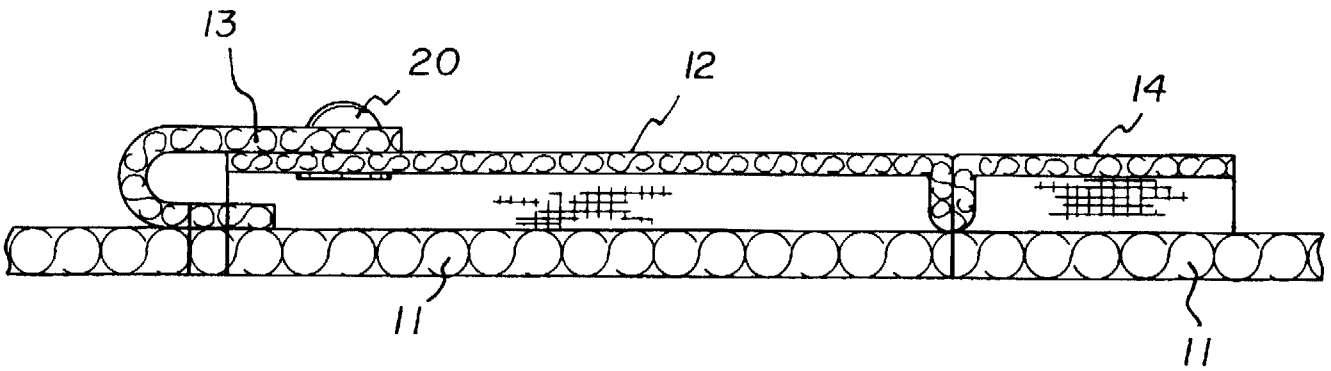
FIG. 5 is a cross sectional view of a harmonica pocket and a note pocket taken along line 5—5 of FIG. 3.
Figure 6:
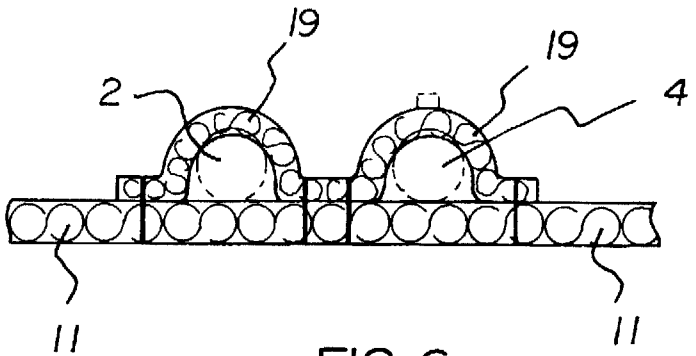
FIG. 6 is a cross sectional view of a pencil-pen holder taken along line 6—6 of FIG. 3.

With reference now to the drawings, and in particular to FIGS. 1 through 6 thereof, a new Harmonica Shoulder Holster embodying the principles and concepts of the present invention and generally designated by the reference numeral 10 will be described.

More specifically, it will be noted that the Harmonica Shoulder Holster 10 comprises a backing material 11, a plurality of harmonica pockets 12, a plurality of note pockets 14, a leg strap 15, a pants strap 16, and a shoulder strap 18 where the plurality of harmonica pockets 12, the plurality of note pockets 14, the leg strap 15, and the pants strap 16 are all connected to the backing material 11, and the shoulder strap 18 is an extension of the backing material 11.

As best illustrated in FIGS. 1 through 6, it can be shown that the harmonica pockets 12 include pocket flaps 13 and pocket attachment means 20 which work together to open and close the harmonica pockets 12 and retainably hold a harmonica 6 in the harmonica pockets 12.

The pocket flaps 13 are further defined as extensions of the harmonica pockets 12 and include a part of the pocket attachment means 20 that matingly and removably attaches to another part of the pocket attachment means 20 which is fixedly attached to the harmonica pockets 12.

The shoulder strap 18 is further defined as an extension of the backing material 11 and further comprises an extended backing 28 and a short side backing 27 which are substantially shaped to allow for a comfortable mating fit with a person's shoulder and are fixedly fastened to the pants strap 16.

The backing material 11 is generally rectangular in shape except for the shoulder strap 18 which is pointed according to the extended backing 28 and narrows down from a full width which last occurs at the short side backing 27.

The pants strap 16 further comprises a strap clamp 17 at a free end and the strap clamp 17 is designed to removably attach to a person's pants for the purpose of supporting the Harmonica Shoulder Holster 10.

The backing material 11 additionally includes a pencil-pen holder 19 which is fixedly fastened to the backing material 11 and matingly receives a pencil 2 and a pen 4.

Additionally, the backing material 11 further comprises a fold 23 and a leg strap loop 25 at a lower end of the backing material 11 where the fold 23 is further defined as a lower extension of the backing material 11 and forms substantially a 180 degree angle and where the leg strap loop 25 is an extension of the fold 23 and where a loose end of the leg strap loop 25 is fixedly attached to the backing material 11 whereby an elongated opening is defined and matingly receives the leg strap 15.

Furthermore, the leg strap 15 is removably retained around a person's leg by a leg strap attachment means 21.

In use, the Harmonica Shoulder Holster 10 is equipped with harmonicas 6, notes, a pen 4, and a pencil 2. The device is then slung over the left shoulder of the musician and the pant straps 16 are then fastened to a musician's pants using the strap clamps 17. Finally, the leg strap 15 is fastened to the musician's left leg using the leg strap attachment means 21.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A harmonica shoulder holster comprising a backing material for placing over the shoulder and extending over the front of the torso of a wearer, said backing material having an upper shoulder strap portion and a lower torso end, a plurality of harmonica pockets each attached to said backing material for removably receiving a harmonica therein, a leg strap for securing the lower torso end of said backing material to the leg of the wearer corresponding to the shoulder over which said shoulder strap portion is placed, said leg strap being attached to said lower torso end for extending about the leg of the wearer, a biasing pants strap being attached to the upper shoulder portion of said backing material at a location thereon to be positioned adjacent to the neck of the wearer, said biasing pants strap being adapted to cross over the back of the torso of the wearer for attachment to the waistband of the wearer's pants at a location below the shoulder opposite the shoulder having said shoulder strap portion placed thereupon, said biasing pants strap being for biasing said shoulder strap portion into a position adjacent to the neck of said wearer, and a support pants strap being attached to the upper shoulder portion of said backing material at a location spaced from the attachment of said biasing pants strap to said shoulder strap portion, said support pants strap being adapted to extend downwardly from the shoulder strap portion for attachment to the waistband of the wearer's pants at a location below said shoulder strap portion and at a location spaced from the attachment of said biasing pants strap to the waistband.

2. The harmonica shoulder holster of claim 1, wherein the harmonica pockets each include a pocket flap and a pocket flap attachment means mounted adjacent to the opening of each harmonica pocket for closing the opening of the harmonica pocket to hold a harmonica in the harmonica pocket.

3. The harmonica shoulder holster of claim 1 wherein the backing material at said lower torso end is folded to form a leg strap loop which receives said leg strap.

4. The harmonica shoulder holster of claim 1 wherein the upper shoulder strap portion of the backing material comprises an extended backing section and a short side backing section, said biasing pants strap being fixedly fastened to said short side backing section and said support pants strap being fixedly fastened to said extended backing section.

5. The harmonica shoulder holster of claim 1 wherein said backing material has a length defined between said upper shoulder strap portion and said lower torso end and has a width transverse to said length, said width having a width dimension of at least six inches to thereby accommodate the mounting of said harmonica pockets in a transverse orientation to the length of said backing material.

6. The harmonica shoulder holster of claim 1 wherein the biasing pants strap and the support pants strap each further comprise a strap clamp at a free end of each pants strap and each strap clamp is designed to removably attach to the waistband of the wearer's pants.

7. The harmonica shoulder holster of claim 6, wherein the backing material additionally includes a pencil-pen holder fixedly fastened to said backing material for receiving a pencil or a pen therein.

8. A harmonica shoulder holster comprising:

a backing material, a plurality of harmonica pockets, a plurality of note pockets, a leg strap, a pants strap, and a shoulder strap where the plurality of harmonica pockets, the plurality of note pockets, the leg strap, and the pants strap are all connected to the backing material, and the shoulder strap is an extension of the backing material;

wherein the harmonica pockets each include a pocket flap and pocket attachment means which work together to open and close the harmonica pockets and for retainably holding a harmonica in one of the harmonica pockets;

wherein the pocket flaps are further defined as extensions of the respective harmonica pockets and include a part of the pocket attachment means that matingly and removably attaches to another part of the pocket attachment means which is fixedly attached to the respective harmonica pockets;

wherein the shoulder strap further comprises an extended backing and a short side backing and the pants strap is fixedly fastened to the short side backing;

wherein the backing material is generally rectangular in shape except for the shoulder strap which is pointed according to the extended backing and narrows down from a full width which last occurs at the short side backing;

wherein the pants strap further comprises a strap clamp at a free end and the strap clamp is designed to removably attach to a person's pants for the purpose of supporting the harmonica shoulder holster;

wherein the backing material additionally includes a pencil-pen holder for receiving a pencil or a pen, said pencil-pen holder being fixedly fastened to the backing material; and wherein the backing material further comprises a fold and a leg strap loop at a lower end of the backing material where the fold is further defined as a lower extension of the backing material and forms substantially a 180 degree angle and where the leg strap loop is an extension of the fold and where a loose end of the leg strap loop is fixedly attached to the backing material whereby an elongated opening is defined and matingly receives the leg strap.

9. The harmonica shoulder holster of claim 8, wherein the leg strap is removably retained around a person's leg by a leg strap attachment means.

10. The harmonica shoulder holster of claim 9, where in use the harmonica shoulder holster is equipped with harmonicas, notes, a pen, and a pencil and where the device is then slung over a left shoulder of the musician and the pant strap are then fastened to the musician's pants using the strap clamp and where the leg strap is fastened to the musician's left leg using the leg strap attachment means.

* * * * *